US012221970B1

(12) United States Patent
Shi

(10) Patent No.: US 12,221,970 B1
(45) Date of Patent: Feb. 11, 2025

(54) INTEGRATED INFLATION AND DEFLATION AIR PUMP

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/739,553

(22) Filed: Jun. 11, 2024

(30) Foreign Application Priority Data

Feb. 5, 2024 (CN) ..... 202420281230.9

(51) Int. Cl.
*F04D 27/00* (2006.01)
*F04D 29/40* (2006.01)

(52) U.S. Cl.
CPC ..... *F04D 27/005* (2013.01); *F04D 29/403* (2013.01)

(58) Field of Classification Search
USPC ..... 417/315
See application file for complete search history.

(56) References Cited

U.S. PATENT DOCUMENTS 2,285,161 A * 6/1942 Jenn ..... F24F 7/013 417/361
4,829,616 A * 5/1989 Walker ..... F04D 25/084 251/129.05
5,349,983 A * 9/1994 Ozarowski ..... F16K 5/10 251/312
5,509,154 A * 4/1996 Shafer ..... A47C 27/082 318/16
6,623,249 B1 * 9/2003 Rogers ..... F04B 41/06 417/428
6,832,629 B2 * 12/2004 Wu ..... F04D 25/084 137/625.21
7,588,425 B2 * 9/2009 Chung ..... A47C 27/082 5/713
8,210,834 B2 * 7/2012 Tsai ..... A47C 27/082 5/713
8,235,684 B2 * 8/2012 Song ..... F04D 25/08 5/713
8,641,391 B2 * 2/2014 Pan ..... F04D 29/503 417/315
8,801,392 B2 * 8/2014 Wang ..... F16K 31/42 5/713

(Continued)

*Primary Examiner* — Essama Omgba
*Assistant Examiner* — Geoffrey S Lee
(74) *Attorney, Agent, or Firm* — Cooper Legal Group, LLC

(57) ABSTRACT

The present application relates to an integrated inflation and deflation air pump, including a housing, a pump body, an adjusting assembly and a control assembly. The housing is provided with a universal air port, an inflation port, and a deflation port. When in an inflated state, the universal air port is in communication with the air inlet, the inflation port is in communication with the air outlet, and, when in a deflated state, the universal air port is in communication with the air outlet, the deflation port is in communication with the air inlet, the adjusting assembly is provided between the housing and pump body and is configured to control a communication relationship between the air inlet, air outlet, universal air port, inflation port, and deflation port. The control assembly is installed on the housing, electrically connected to the pump body to control operation of the pump body.

8 Claims, 4 Drawing Sheets

(56) References Cited

U.S. PATENT DOCUMENTS

| | | | | |
|---|---|---|---|---|
| 9,879,682 | B1 * | 1/2018 | Beliveau | A47C 27/082 |
| 10,443,602 | B2 * | 10/2019 | Liu | F04D 29/083 |
| 2003/0099560 | A1 * | 5/2003 | Wang | F04D 29/503<br>417/423.1 |
| 2004/0163181 | A1 * | 8/2004 | Wu | A61G 7/05776<br>5/713 |
| 2007/0000061 | A1 * | 1/2007 | Chung | F04D 29/503<br>417/423.14 |
| 2010/0247337 | A1 * | 9/2010 | Tsai | F04D 29/602<br>417/423.1 |
| 2013/0230410 | A1 * | 9/2013 | Tsai | A47C 27/083<br>417/32 |
| 2015/0308454 | A1 * | 10/2015 | Shi | F04D 27/008<br>415/151 |
| 2017/0280884 | A1 * | 10/2017 | Liu | A47C 27/082 |
| 2018/0335042 | A1 * | 11/2018 | Lin | F04D 29/503 |
| 2023/0093808 | A1 * | 3/2023 | Huang | F04D 25/084<br>417/315 |

* cited by examiner

INTEGRATED INFLATION AND DEFLATION AIR PUMP

CROSS-REFERENCE TO RELATED APPLICATION

The present application is based on and claims the priority benefits of China application No. 202420281230.9, filed on Feb. 5, 2024. The entirety of China application No. 202420281230.9 is hereby incorporated by reference herein and made a part of this specification.

TECHNICAL FIELD

The present application relates to a technical field of air pump, and, in particular, to an integrated inflation and deflation air pump.

BACKGROUND ART

On a large inflatable product (such as an inflatable bed), an air pump is installed to achieve automatic inflation and deflation. Due to different directions of wind during inflation and deflation processes, some inflatable products will be separately installed with an inflation pumps and a deflation pump to achieve inflation and deflation functions, which, however, is costly and results in relatively space occupied by the air pump. Another way is to provide an air pump detachable relative to an air port of the inflatable product, so as to conveniently change a connection between the air pump and the air port of the inflatable product. When it is necessary to inflate the inflatable product, an air outlet of the air pump is connected to the air port of the inflatable product, and when it is necessary to deflate the inflatable product, an air inlet of the air pump to the air port of the inflatable product. However, this method involves in complex operation and inconvenient use.

SUMMARY

In order to improve a convenience of using an air pump, the present application provides an integrated inflation and deflation air pump.

The integrated inflation and deflation air pump provided in the present application adopts the following technical solution:

The integrated inflation and deflation air pump, comprising:

- a housing provided with a universal air port, an inflation port, and a deflation port;
- a pump body is provided with an air inlet and an air outlet, wherein, when the integrated inflation and deflation air pump is in an inflation mode, the universal airport is in communication with the air inlet, the inflation port is in communication with the air outlet, and when the integrated inflation and deflation air pump is in a deflation mode, the universal air port is in communication with the air outlet, and the deflation port is in communication with the air inlet;
- an adjusting assembly is provided between the housing and the pump body, wherein, the adjusting assembly is configured to control a communication relationship between the air inlet, the air outlet, the universal air port, the inflation port, and deflation port; and
- a control assembly is installed on the housing, wherein, the control assembly is electrically connected to the pump body, and the control assembly is configured to control an operation of the pump body.

By adopting the above technical solution, in the inflation mode, by a control of the adjusting assembly, the universal air port is in communication with the air inlet, and the inflation port is in communication with the air outlet, thereby enabling the air pump to achieve inflation function. While in the deflation mode, the universal air port is in communication with the air outlet, and the deflation port is in communication with the air inlet, thereby achieving a deflation function. The adjusting assembly plays a crucial control role to ensure air port connections of the air pump meet requirements in different states.

In addition, the control assembly is installed on the housing and electrically connected to the pump body, configured for controlling an operation control of an entire air pump. This design allows for flexible switching of the integrated inflation and deflation air pump under different working conditions, meeting both inflation and deflation needs, while avoiding a cost and space waste caused by installing two independent air pumps.

Therefore, the above work process is simple and efficient, and users only need to control the working conditions of the air pump through simple operations, without a need to replace the air pump or connect the air port, greatly improving a convenience of use. In addition, due to an integrated design, the air pump is more economical and practical in terms of space occupancy and cost compared to a technical solution of using two independent air pumps.

Optionally, the pump body comprises a cover body and a fan assembly, the cover body is installed inside the housing, the fan assembly is inclinably provided inside the cover body, the air inlet and the air outlet are respectively defined at two ends of the fan assembly, and the cover body is provided with two sets of air vents in staggered arrangement with each other, a first set of the air vents is configured to achieve communication between the universal air port and the air inlet, and communication between the inflation port and the air outlet, a second set of the air vents is configured to achieve communication between the universal air port and the air outlet, and communication between the deflation port and the air inlet.

By adopting the above technical solution, the cover body is installed in the housing, while the fan assembly rotates and is carried inside the cover body, with the air inlet and the air outlet located at two ends of the fan assembly. Two sets of air vents are provided on the cover body, which are cleverly arranged in the staggered arrangement with each other, wherein the first set of the air vents is configured to achieve a connection between the universal air port and the air inlet, and a connection between the inflation port and the air outlet in the inflation mode, while the second set of air vents is configured to achieve a connection between the universal air port and the air outlet, and a connection between the deflation port and the air inlet in the deflation mode.

During an inflation process, the air pump introduces the air through the universal air port, allowing the air to flows smoothly into the air inlet through the air vent which is provided in the staggered arrangement with each other. In addition, the second set of the air vents exhausts the air through the inflation port. In the deflation mode, by adjusting the communication relationship of the air vent, the universal air port is in communication with the air outlet, while the deflation port is in communication with the air inlet, allowing the air to flow out quickly and smoothly. This design effectively simplifies a structure of the air pump, improves an inflation and deflation efficiency of an inflatable product, and makes operation more convenient.

Optionally, the adjusting assembly comprises a toggling switch and a connecting seat, the toggling switch is slidably provided on the housing along a horizontal direction, the toggling switch is defined with a movable slot, the connecting seat is fixed to an outer wall of the fan assembly, and a side wall of the connecting seat is fixed with a transmission rod, and the transmission rod slidably provided inside the movable slot.

By adopting the above technical solution, during a working process, users can slide the toggling switch horizontally, and due to a presence of the movable slot, this action will be transmitted to the transmission rod on the connecting seat, which drives an entire fan assembly to rotate. A transmission process realizes an adjustment of an angle of the fan assembly, further adjusting connectivity of the air passages in the entire air pump, and improving the user experience and convenience of operation.

Optionally, the adjusting assembly further comprises a limiting switch, the limiting switch is provided inside the housing, the limiting switch is electrically connected to the control assembly, and the limiting switch is located on a side of the toggling switch, two sides of the toggling switch are provided with a protrusion respectively, and, wherein, when the toggling switch moves left or right for a certain distance, the protrusion squeezes the limiting switch.

By adopting the above technical solution, when the toggling switch moves the certain distance to the left or right, the protrusion will squeeze the limiting switch, the limiting switch will transmit a signal to the control assembly, which controls the fan assembly to turn on. When the fan assembly drives the protrusion to move to another positions, the protrusion disengages from the limiting switch, which transmits another signal to the control assembly to control the fan assembly to shut down.

Optionally, the housing is provided with a switch cover, the switch cover is provided with a sliding slot, the toggling switch comprises a toggling portion and a connecting portion, wherein the toggling portion is fixed on an upper side of the connecting portion, the connecting portion is slidably provided in the sliding slot, and the protrusion and the movable slot are both provided on the connecting portion.

By adopting the above technical solution, the sliding slot allows the connecting portion of the toggling switch to slide horizontally inside the housing. By sliding the connecting portion into the sliding slot, the toggling switch can move left and right inside the housing without a need to detach from the switch cover, providing a more convenient and compact operating method. In addition, the protrusion and the movable slot on the connecting portion cooperate with the sliding slot, ensuring a stability and accuracy of the toggling switch during a sliding process.

Optionally, the control assembly comprises a PCB support, a first PCB motherboard, and a second PCB motherboard, the PCB support is installed inside the housing, the first PCB motherboard and the second PCB motherboard are installed vertically at intervals on the PCB support, the first PCB motherboard, the second PCB motherboard, the limiting switch, and the fan assembly are electrically connected.

By adopting the above technical solution, when the limiting switch senses that a position of the fan assembly reaches an open state, the limiting switch will send a signal to the first PCB motherboard and the second PCB motherboard, thereby controlling a start of the fan assembly. This design enables an opening and closing of the fan assembly to be achieved within a controllable range of a system, ensuring a safe operation of the fan assembly. In addition, a vertical arrangement of the first PCB motherboard and the second PCB motherboard has certain advantages in terms of space occupancy. By vertically arranging, the first PCB motherboard and the second PCB motherboard can effectively utilize smaller space, thereby saving device volume. In addition, vertical arrangement can further help reduce a level of electromagnetic interference between the first PCB motherboard and the second PCB motherboard, improving a reliability and stability of the system.

Optionally, the housing is defined with a line collecting slot at a side of the control assembly, and the line collecting slot is in communication with the universal air port.

By adopting the above technical solution, the line collecting slot provides a safe and isolated space for organizing and wiring wires and cables of the control assembly. This helps to reduce a confusion and entanglement of wires, and improve the reliability and maintainability of the system, a providing of the line collecting slot further helps to simplify an installation and maintenance process. By concentrating all wires and cables into a fixed space, users can more easily route and connect them.

Optionally, the housing is further hinged with a line collecting box cover, covering the universal air port, and a surface of the line collecting box cover is defined with a through hole.

By adopting the above technical solution, a design of a hinged line collecting box cover and the through hole on the surface of the line collecting box cover play an important role in protection, the line collecting box cover provides a physical barrier to reduce external objects from entering the line collecting slot, while also protecting internal connectors and wires from damage, the through hole ensures a normal flow of air.

Optionally, the inflation port and the deflation port are both provided with a one-way valve plate.

By adopting the above technical solution, an open design of the one-way valve plate allows the air to enter the housing in a one-way flow manner without a need for additional manual operation. In addition, an automatic closing mechanism of the one-way valve plate can avoid air leakage and make an inflation and deflation process more convenient and fast. In addition, the one-way valve plate further enhances a safety of the system, preventing unnecessary pressure increase or decrease, limiting interference from external environment on the air pump, and ensuring stable operation of the air pump.

Optionally, the inflation port is further provided with a secondary diversion carrier.

By adopting the above technical solution, the secondary diversion carrier can help control an air flow rate. By adjusting an opening of the secondary diversion carrier, an output of the inflation port can be adjusted according to demands and requirements.

In summary, the present application includes at least one of the following beneficial technical effects:

1. users only need to control the working conditions of the air pump through simple operations, without the need to replace the air pump or connect the air port, greatly improving the convenience of use. In addition, due to the integrated design, the air pump is more economical and practical in terms of space occupancy and cost compared to the solution of using two independent air pumps;
2. by vertical arrangement, the first PCB motherboard and the second PCB motherboard can effectively utilize smaller space, thereby saving device volume. In addition, vertical arrangement can further help reduce the level of electromagnetic interference between the first PCB motherboard and the second PCB motherboard, improving the reliability and stability of the system; and 3. the providing of the line collecting slot further helps to simplify the installation and maintenance process. By concentrating all wires and cables into the fixed space, users can more easily route and connect them.

DETAILED DESCRIPTION

The present application will be further described in detail below with reference to FIGS. 1-4.

Figure 1:
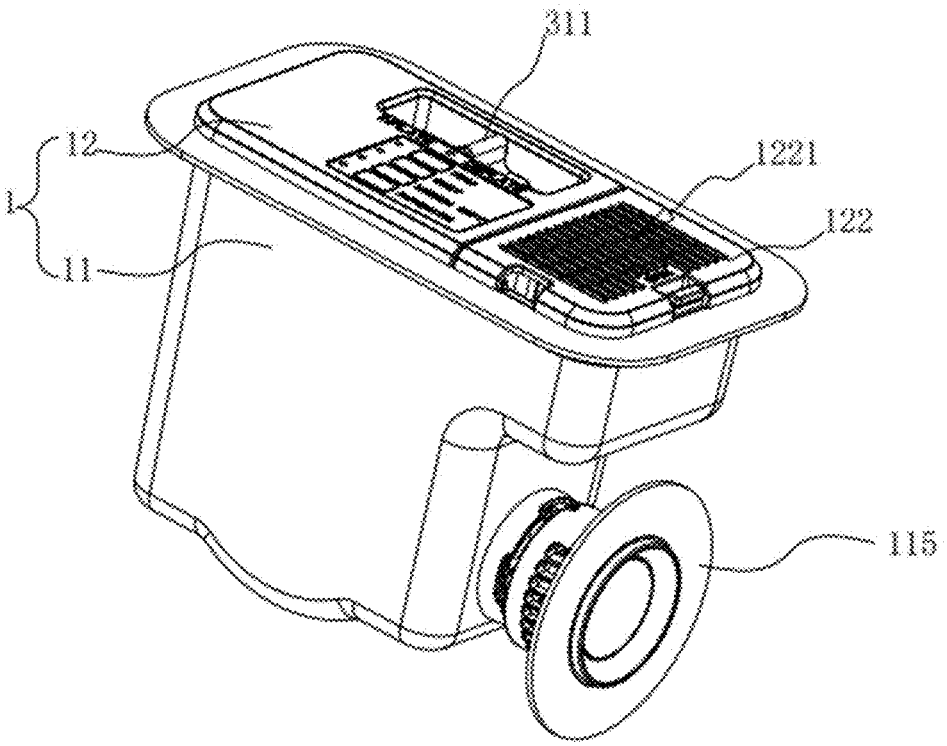
FIG. 1 is a schematic structure view of an integrated inflation and deflation air pump according to an embodiment of the present application.
Figure 2:
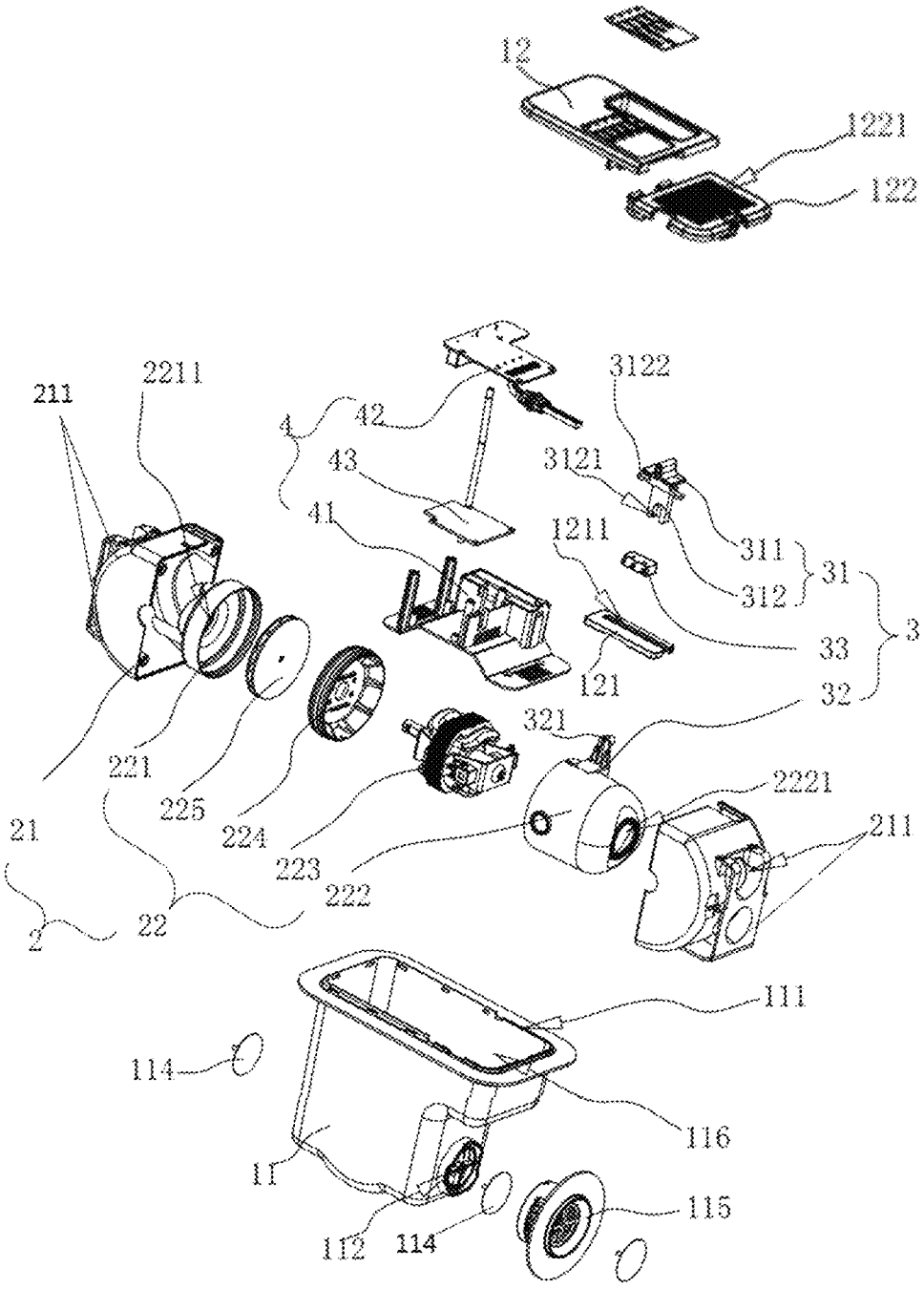
FIG. 2 is an explosion schematic view of the integrated inflation and deflation air pump according to an embodiment of the present application.

An embodiment of the present application provides an integrated inflation and deflation air pump. Referring to FIGS. 1 and 2, the integrated inflation and deflation air pump includes a housing 1, a pump body 2, an adjusting assembly 3 and a control assembly 4, the housing 1 is configured to accommodate the pump body 2, the adjusting assembly 3 and the control assembly 4, the adjusting assembly 3 is configured to adjust a working condition of the air pump, the control assembly 4 is electrically connected to the pump body 2, and the control assembly 4 is configured to control an operation of the pump body 2.

Specifically, the housing 1 includes a bottom housing 11 and a panel 12, the bottom housing 11 is hollow, the panel 12 covers the bottom housing 11, and the panel 12 is in snap connection with the bottom housing 11. Meanwhile, the bottom housing 11 is provided with a universal air port 111, an inflation port 112, and a deflation port 113 (combining with FIG. 3). In particular, the universal air port 111 is provided at a top of the bottom housing 11 and is located on a side of the panel 12, the inflation port 112 is provided at a right side of the bottom housing 11, and the deflation port 113 is provided at a left side of the bottom housing 11. Correspondingly, all of the universal air port 111, the inflation port 112, and the deflation port 113 communicates with inside of the bottom housing 11.

Correspondingly, the pump body 2 includes a cover body 21 and a fan assembly 22, the cover body 21 is formed by combining two half housings, and the fan assembly 22 is correspondingly provided inside the cover body 21 and inclinably connected to the cover body 21. In addition, a left side of the fan assembly 22 is provided with an air inlet 2211, a right side of the fan assembly 22 is provided with an air outlet 2221, air enters the air inlet 2211 of the fan assembly 22, and flows out from the air outlet 2221, achieving air circulation.

In addition, the cover body 21 is provided with two sets of air vents 211, which are provided in a staggered manner. In particular, a set of air vents 211 is configured to achieve a communication between the universal air port 111 and the air inlet 2211, as well as a communication between the inflation port 112 and the air outlet 2221, while the other set of air vents 211 is configured to achieve a communication between the universal air port 111 and the air outlet 2221, as well as a communication between the deflation port 113 and the air inlet 2211.

Specifically, there are two sets of air vents 211. In particular, two air vents 211 in one set are respectively defined in a upper left corner and a lower right corner of the cover body 21, correspondingly, two air vents 211 in the other set are respectively defined in a lower left corner and an upper right corner of the cover body 21.

Figure 3:
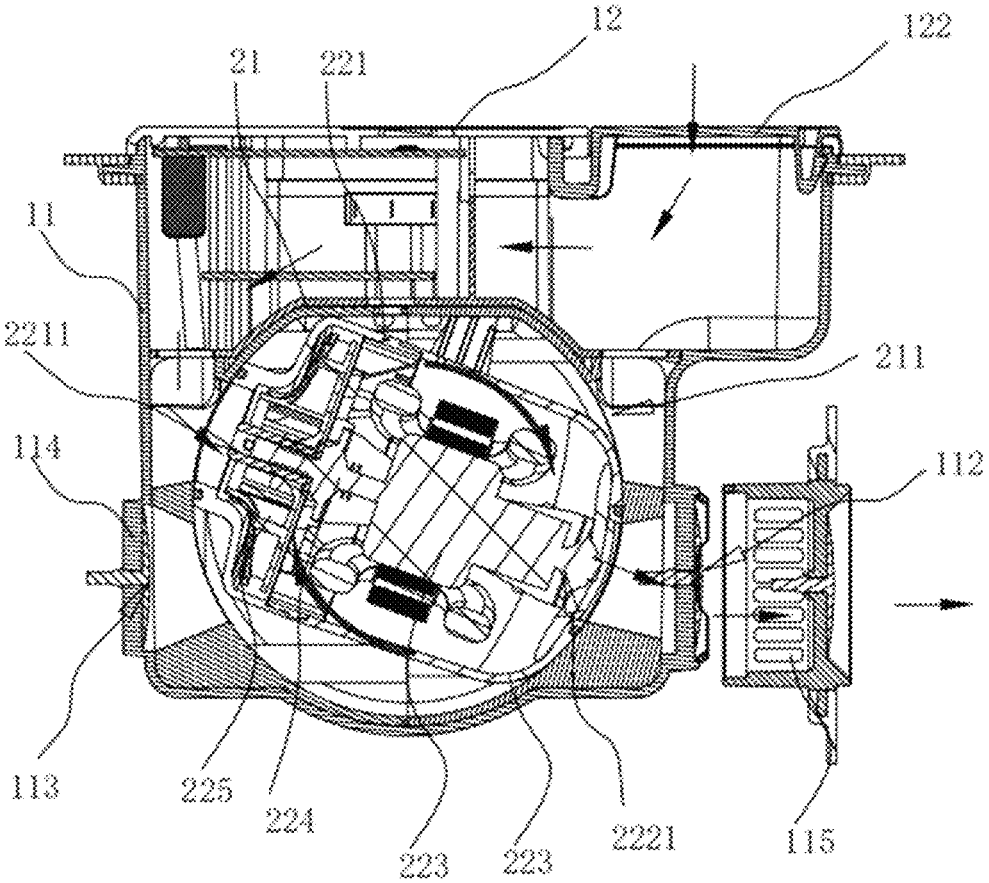
FIG. 3 is a schematic cross-sectional view of the integrated inflation and deflation air pump during inflation according to an embodiment of the present application.
Figure 4:
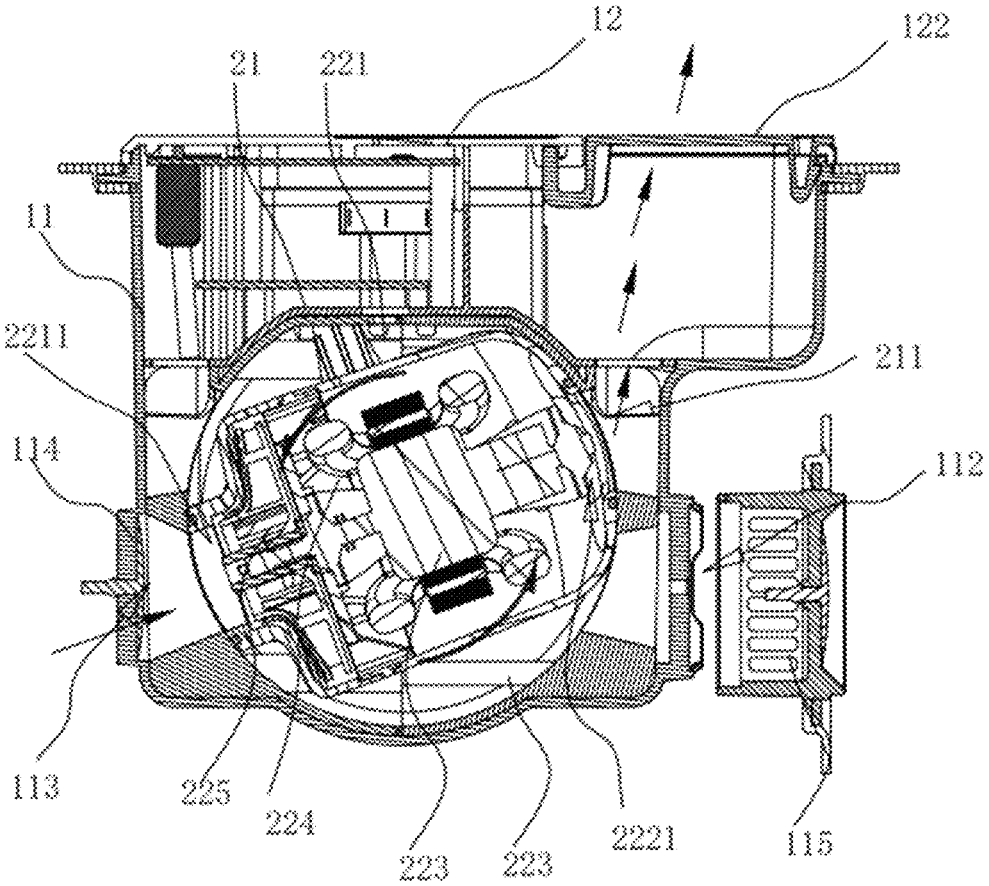
FIG. 4 is a schematic cross-sectional view of the integrated inflation and deflation air pump during deflation according to an embodiment of the present application.

Referring to FIGS. 3 and 4, correspondingly, the adjusting assembly 3 is specifically configured to adjust a rotation angel of the fan assembly 22. Under a control of the adjusting assembly 3, when the fan assembly 22 rotates to form an inclination of 45° angle with a horizontal plane, two types of air passages are formed between the pump body 2 and the housing 1.

When the air pump is inflated, the air inlet 2211 of the fan assembly 22 is in communication with the air vent 211 which is located in the upper left corner of the cover body 21, further allowing the universal air port 111 to be in communication with the air vent 211 in the upper left corner of the cover body 21, whereas the air vent 211 in the lower left corner of the cover body 21 is blocked by the fan assembly 22. Meanwhile, the air outlet 2221 of the fan assembly 22 is in communication with the air vent 211 in the lower right corner of the cover body 21, further allowing the inflation port 112 to be in communication with the air vent 211 in the lower right corner of the cover body 21, the air vent 211 in the upper right corner of the cover body 21 is blocked by the fan assembly 22.

When the air pump is deflated, the air inlet 2211 of the fan assembly 22 is in communication with the air vent 211 which is located in the lower left corner of the cover body 21, further allowing the universal air port 111 to be in communication with the air vent 211 in the lower left corner of the cover body 21, the air vent 211 in the upper left corner of the cover body 21 is blocked by the fan assembly 22. Additionally, the air outlet 2221 of the fan assembly 22 is in communication with the air vent 211 in the upper right corner of the cover body 21, further allowing the deflation port 113 to be in communication with the air vent 211 in the upper right corner of the cover body 21, the air vent 211 in the lower right corner of the cover body 21 is blocked by the fan assembly 22.

Therefore, a gas is introduced by the air pump introduces through the universal air port 111, flows smoothly into the air inlet 2211 through the air vent 211 which is provided in the staggered manner, while the air is emitted from the other set of air vent 211 through the inflation port 112. In the deflation mode, by adjusting a communication relationship of the air vent 211, the universal air port 111 is in communication with the air outlet 2221, while the deflation port 113 is in communication with the air inlet 2211, allowing the gas to flow out quickly and smoothly. This design effectively simplifies a structure of the air pump, improves an inflation and deflation efficiency of the inflatable product, and makes operation more convenient.

Referring back to FIGS. 1 and 2, in the embodiment, the fan assembly 22 includes a top flow control cover 221, a bottom flow control cover 222, an AC motor 223, a flow guiding cover 224, and a fan blade 225. The top flow control cover 221 is covered and fixed with the bottom flow control cover 222, the air inlet 2211 is defined in the top flow control cover 221, and the air outlet 2221 is defined in the bottom flow control cover 222. In addition, the AC motor 223 is fixed inside a cavity formed by the top flow control cover 221 and the bottom flow control cover 222, the flow guiding cover 224 is installed at a front end of the AC motor 223, and the fan blade 225 is installed on an output shaft of the AC motor 223.

Therefore, the top flow control cover 221 and the bottom flow control cover 222 are sealingly docked and snap fixed with each other, forming a closed cavity. The AC motor 223 is firmly installed in the cavity and connected to the top flow control cover 221 and the bottom flow control cover 222. The flow guiding cover 224 is tightly installed at the front end of the AC motor 223, serving a function of guiding an air flow. The fan blade 225 is mounted on the output shaft of the AC motor 223.

For operation, the AC motor 223 is started, and the output shaft drives the fan blade 225 to rotate. The flow guiding cover 224 helps to guide a direction of the air flow, allowing it to pass smoothly through the fan blade 225. Structures of the top flow control cover 221 and the bottom flow control cover 222 and fixed connection with each other ensure an orderly flow of the air flow in a system, preventing air backflow or leakage. This helps to improve an efficiency and performance of the fan assembly 22.

In addition, the fan blade 225 generates the air flow during a rotating process, which is guided by the flow guiding cover 224 and transmitted in an orderly manner along channels of the top flow control cover 221 and the bottom flow control cover 222. The top flow control cover 221 and the bottom flow control cover 222 facilitates reduced turbulence and more stable air flow. Through a process, the fan assembly 22 achieves a function of converting mechanical energy into airflow kinetic energy.

In summary, in the inflation mode, by controlling of the adjusting assembly 3, the universal air port 111 is in communication with the air inlet 2211, and the inflation port 112 is in communication with the air outlet 2221, thereby enabling the air pump to achieve inflation function. While in the deflation mode, the universal air port 111 is in communication with the air outlet 2221, and the deflation port 113 is in communication with the air inlet 2211, thereby achieving a deflation function. The adjusting assembly 3 plays a crucial control role to ensure air port connections of the air pump meet requirements in different states.

In addition, the control assembly 4 is installed on the housing 1 and electrically connected to the pump body 2, responsible for controlling an operation control of an entire air pump. This design allows for flexible switching of the integrated inflation and deflation air pump under different working conditions, meeting both inflation and deflation needs, while avoiding a cost and space waste caused by installing two independent air pumps.

Therefore, the above work process is simple and efficient, and users only need to control the working conditions of the air pump through simple operations, without a need to replace the air pump or connect the air port, greatly improving a convenience of use. In addition, due to an integrated design, the air pump is more economical and practical in terms of space occupancy and cost compared to a solution of using two independent air pumps.

Further, both the inflation port 112 and the deflation port 113 are provided with a one-way valve plate 114. In the embodiment, the one-way valve plate 114 is made of silicone gel, and the inflation port 112 is further provided with a secondary diversion carrier 115.

Therefore, an open design of the one-way valve plate 114 allows the air to enter the housing 1 in a one-way flow manner, without a need for additional manual operation. In addition, an automatic closing mechanism of the one-way valve plate 114 can avoid air leakage and make an inflation and deflation process more convenient and fast. In addition, the one-way valve plate 114 further enhances a safety of the system, preventing unnecessary pressure increase or decrease, limiting interference from external environment on the air pump, and ensuring stable operation of the air pump.

In addition, the secondary diversion carrier 115 can help control an air flow rate. By adjusting an opening degree of the secondary diversion carrier 115, an output of the inflation port 112 can be adjusted according to demands and requirements.

On an other hand, the adjusting assembly 3 includes a toggling switch 31, a connecting seat 32, and a limiting switch 33. In particular, the toggling switch 31 includes a toggling portion 311 and a connecting portion 312, the toggling portion 311 is fixed above the connecting portion 312, and the toggling portion 311 is fixed to the connecting portion 312. In addition, the panel 12 is provided with a switch cover 121, which is provided with a sliding slot 1211, and the connecting portion 312 is slidably provided in the sliding slot 1211.

Correspondingly, the connecting seat 32 is fixed on side walls of the top flow control cover 221 and the bottom flow control cover 222, a side wall of the connecting portion 312 is defined with a movable slot 3121, and an end of the movable slot 3121 is passed through an end face of the connecting portion 312, a side wall of the connecting seat 32 is fixed with a transmission rod 321, which is slidably provided inside the movable slot 3121, In addition, the transmission rod 321 can rotate relative to the connecting portion 312.

Therefore, for operation, a user can slide the toggling switch 31 horizontally, and due to a presence of the movable slot 3121, this action will be transmitted to the transmission rod 321 on the connecting seat 32, which drives an entire fan assembly 22 to rotate. A transmission process realizes an adjustment of an angle of the fan assembly 22, further adjusting connectivity of the air passages in the entire air pump, and improving the user experience and convenience of operation.

In addition, the sliding slot 1211 allows the connecting portion 312 of the toggling switch 31 to slide horizontally inside the housing 1. By sliding the connecting portion 312 into the sliding slot 1211, the toggling switch 31 can move left and right inside the housing 1 without a need to detach from the switch cover 121, providing a more convenient and compact operating method.

Furthermore, the control assembly 4 includes a PCB support 41, a first PCB motherboard 42, and a second PCB motherboard 43. The PCB support 41 is installed inside the housing 1, the first PCB motherboard 42 and the second PCB motherboard 43 are installed vertically at intervals on the PCB support 41, the first PCB motherboard 42, the second PCB motherboard 43, the limiting switch 33, and the fan assembly 22 are electrically connected.

Correspondingly, the limiting switch 33 is correspondingly installed on the PCB support 41, and the limiting switch 33 is electrically connected to the first PCB motherboard 42, the second PCB motherboard 43, and the AC motor 223. In addition, both sides of a side wall of the connecting portion 312 are fixed with two protrusions 3122, which are spaced along a horizontal direction, when the toggling switch 31 is moved to left or right for a certain distance, the protrusions 3122 squeeze the limiting switch 33.

In summary, during the working process, users can slide the toggling switch 31 horizontally, and, due to the presence of the movable slot 3121, the action will be transmitted to the transmission rod 321 on the connecting seat 32, which drives the entire fan assembly 22 to rotate. The transmission process realizes the adjustment of the angle of the fan assembly 22, further adjusting the connectivity of the air passages in the entire air pump, and improving the user experience and convenience of operation.

In addition, when the toggling switch 31 moves a certain distance to the left or right, the protrusions 3122 will squeeze the limiting switch 33, the limiting switch 33 will send a signal to the control assembly 4, which controls the fan assembly 22 to turn on. During this process, the protrusions 3122 and the movable slot 3121 on the connecting portion 312 cooperate with the sliding slot 1211, ensuring a stability and accuracy of the toggling switch 31 during a sliding process. In addition, when the fan assembly 22 drives the protrusions 3122 to move to another positions, the protrusions 3122 disengage from the limiting switch 33, which sends another signal to the control assembly 4 to control the fan assembly 22 to shut down.

On the other hand, when the limiting switch 33 senses that a position of the fan assembly 22 reaches an open state, the limiting switch 33 will send a signal to the first PCB motherboard 42 and the second PCB motherboard 43, thereby controlling a start of the fan assembly 22. This design enables an opening and closing of the fan assembly 22 to be achieved within a controllable range of the system, ensuring a safe operation of the fan assembly 22.

In addition, a vertical arrangement of the first PCB motherboard 42 and the second PCB motherboard 43 has certain advantages in terms of space occupancy. By vertically arranging, the first PCB motherboard 42 and the second PCB motherboard 43 can effectively utilize smaller space, thereby saving device volume. In addition, vertical arrangement can further help reduce a level of electromagnetic interference between the first PCB motherboard 42 and the second PCB motherboard 43, improving a reliability and stability of the system.

On the other hand, a line collecting slot 116 is defined inside the bottom housing 11, which is located on a side of the control assembly 4, and the line collecting slot 116 is in communication with the universal air port 111. In addition, a side wall of the panel 12 is further hinged with a line collecting box cover 122, which is covered above the universal air port 111, a surface of the line collecting box cover 122 is provided with a through hole 1221.

Correspondingly, the line collecting slot 116 provides a safe and isolated space for organizing and wiring wires and cables of the control assembly 4. This helps to reduce a disorder and entanglement of wires, and improve the reliability and maintainability of the system, a providing of the line collecting slot 116 further helps to simplify an installation and maintenance process. By concentrating all wires and cables into a fixed space, a user can more easily route and connect them.

In addition, a design of a hinged line collecting box cover 122 and the through hole 1221 on the surface of the line collecting box cover 122 play an important role in protection, the line collecting box cover 122 provides a physical barrier to reduce external objects from entering the line collecting slot 116, while also protecting internal connectors and wires from damage, the through hole 1221 ensures a normal flow of air.

An implementation principle of the integrated inflation and deflation air pump according to an embodiment of the present application is as follows.

In the inflation mode, under the control of the adjusting assembly 3, the universal air port 111 is in communication with the air inlet 2211, and the inflation port 112 is in communication with the air outlet 2221, thereby enabling the air pump to achieve inflation function. While in the deflation mode, the universal air port 111 is in communication with the air outlet 2221, and the deflation port 113 is in communication with the air inlet 2211, thereby achieving the deflation function. The adjusting assembly 3 plays the crucial control role to ensure air port connections of the air pump meet requirements in different states.

In addition, the control assembly 4 is installed on the housing 1 and electrically connected to the pump body 2, responsible for controlling the operation control of the entire air pump. This design allows for flexible switching of the integrated inflation and deflation air pump under different working conditions, meeting both inflation and deflation needs, while avoiding the cost and space waste caused by installing two independent air pumps.

Therefore, the above work process is simple and efficient, and users only need to control the working conditions of the air pump through simple operations, without the need to replace the air pump or connect the air port, greatly improving the convenience of use. In addition, due to the integrated design, the air pump is more economical and practical in terms of space occupancy and cost compared to the solution of using two independent air pumps.

The above are the preferred embodiments of the present application, which are not intended to limit the protection scope of the present application. Therefore, all equivalent changes made according to the structure, shape and principle of the present application should be covered within the protection scope of the present application.

LISTING OF REFERENCE SIGNS

1. Housing
11. Bottom Housing
111. Universal Air Port
112. Inflation Port
113. Deflation Port
114. One-way Valve Plate
115. Secondary Diversion Carrier
116. Line Collecting Slot
12. Panel
121. Switch Cover
1211. Sliding Slot
122. Line Collecting Box Cover
1221. Through Hole
2. Pump Body
21. Cover Body
211. Air Vent
22. Fan
221. Top flow control cover
2211. Air Inlet
222. Bottom flow control cover
2221. Air Outlet
223. Ac Motor
224. Flow Guiding Cover
225. Fan Blade
3. Adjusting Assembly

31. Toggling Switch
311. Toggling Portion
312. Connecting Portion
3121. Movable Slot
3122. Protrusion
32. Connecting Seat
321. Transmission Rod
33. Limiting Switch
4. Control Assembly
41. PCB support
42. First PCB Motherboard
43. Second PCB Motherboard

What is claimed is:

1. An integrated inflation and deflation air pump, comprising:

a housing, provided with a universal air port, an inflation port, and a deflation port;

a pump body provided with an air inlet and an air outlet, wherein, when the integrated inflation and deflation air pump is in an inflation mode, the universal air port is in communication with the air inlet, and the inflation port is in communication with the air outlet, and when the integrated inflation and deflation air pump is in a deflation mode, the universal air port is in communication with the air outlet, and the deflation port is in communication with the air inlet;

an adjusting assembly provided between the housing and the pump body, wherein the adjusting assembly is configured to control a communication between the air inlet, the air outlet, the universal air port, the inflation port, and the deflation port; and a control assembly installed on the housing, wherein the control assembly is electrically connected to the pump body, and the control assembly is configured to control an operation of the pump body, wherein the pump body comprises a cover body and a fan assembly, the cover body is installed inside the housing, the fan assembly is inclinably carried inside the cover body, the air inlet and the air outlet are respectively defined at two ends of the fan assembly, the cover body is provided with two sets of air vents in staggered arrangement with each other, a first set of the two sets of air vents is configured to achieve communication between the universal air port and the air inlet and communication between the inflation port and the air outlet, and a second set of the two sets of air vents is configured to achieve communication between the universal air port and the air outlet and communication between the deflation port and the air inlet.

2. The integrated inflation and deflation air pump according to claim 1, wherein the adjusting assembly comprises a toggling switch and a connecting seat, the toggling switch is slidably provided on the housing along a horizontal direction, the toggling switch is defined with a movable slot, the connecting seat is fixed to an outer wall of the fan assembly, a side wall of the connecting seat is fixed with a transmission rod, and the transmission rod slidably provided inside the movable slot.

3. The integrated inflation and deflation air pump according to claim 2, wherein the adjusting assembly further comprises a limiting switch, the limiting switch is provided inside the housing, the limiting switch is electrically connected to the control assembly, the limiting switch is located on a side of the toggling switch, two sides of the toggling switch are provided with a protrusion, respectively, and, when the toggling switch moves left or right by a specified distance, the protrusion squeezes the limiting switch.

4. The integrated inflation and deflation air pump according to claim 3, wherein the housing is provided with a switch cover, the switch cover is provided with a sliding slot, the toggling switch comprises a toggling portion and a connecting portion, the toggling portion is fixed on an upper side of the connecting portion, the connecting portion is slidably provided in the sliding slot, and the protrusion and the movable slot are both provided on the connecting portion.

5. The integrated inflation and deflation air pump according to claim 3, wherein the control assembly comprises a printed circuit board (PCB) support, a first PCB motherboard, and a second PCB motherboard, the PCB support is installed inside the housing, the first PCB motherboard and the second PCB motherboard are installed vertically at intervals on the PCB support, and the first PCB motherboard, the second PCB motherboard, the limiting switch, and the fan assembly are electrically connected.

6. The integrated inflation and deflation air pump according to claim 5, wherein the housing is defined with a line collecting slot at a side of the control assembly, and the line collecting slot is in communication with the universal air port.

7. The integrated inflation and deflation air pump according to claim 6, wherein the housing is further hinged with a line collecting box cover covering the universal air port, and a surface of the line collecting box cover is defined with a through hole.

8. The integrated inflation and deflation air pump according to claim 1, wherein the inflation port and the deflation port are both provided with a one-way valve plate.

* * * * *